United States Patent [19]

Dennis, Jr. et al.

[11] 4,412,814

[45] Nov. 1, 1983

[54] APPARATUS AND METHOD FOR OPERATING A BRICK KILN

[76] Inventors: Silas P. Dennis, Jr.; Tony M. Dennis, both of P.O. Box 279, Albemarle, N.C. 28001

[21] Appl. No.: 333,174

[22] Filed: Dec. 21, 1981

[51] Int. Cl.[3] ..... F27B 9/00

[52] U.S. Cl. ..... 432/146; 110/102; 110/260

[58] Field of Search ..... 110/102, 260, 261, 262, 110/347; 431/284, 285; 432/146, 141, 135, 137

[56] References Cited

U.S. PATENT DOCUMENTS

| | | | |
|---|---|---|---|
| 3,874,844 | 4/1975 | Behrens et al. | 432/146 |
| 4,181,496 | 1/1980 | Arriaga-Ortiz | 432/146 |
| 4,184,436 | 1/1980 | Palm et al. | 110/102 |
| 4,283,170 | 8/1981 | Leisenberg | 432/137 |

FOREIGN PATENT DOCUMENTS

| | | | |
|---|---|---|---|
| 2070761 | 9/1981 | United Kingdom | 110/261 |

*Primary Examiner*—Edward G. Favors
*Assistant Examiner*—Steven E. Warner
*Attorney, Agent, or Firm*—Bell, Seltzer, Park & Gibson

[57] ABSTRACT

Heated waste gases are directed from the tunnel of a brick kiln into a dryer for effective drying of sawdust which is then fed from the dryer into a grinder which reduces the sawdust to finely divided wood fibers and then delivers the ground sawdust to a storage hopper. Apparatus is provided for directing an airstream from a source into and through each of a plurality of burner units positioned along the tunnel of the kiln and extending into the tunnel for generating the desired heat for treatment of the brick, and further, means are provided for feeding the dried ground sawdust from the storage hopper into the airstream in each of the burner units so that the airstream induces the flow of sawdust from the storage means into each of the burner units for the sawdust thus being utilized as the fuel for the burners.

7 Claims, 13 Drawing Figures

APPARATUS AND METHOD FOR OPERATING A BRICK KILN

This invention relates to the operation of a kiln and more particularly to an apparatus and attendant process for utilizing a more economical fuel for operation of the kiln. More particularly, this invention relates to the use of sawdust as the main fuel for a kiln and to an attendant apparatus and process for effectively treating, drying and feeding the dried sawdust to the kiln and including the utilization of otherwise exhausted-to-atmosphere waste kiln gases for economically effecting the drying of the sawdust by driving off and removing the high moisture content normally present in sawdust.

As is well known to those versed in the operation of kilns, such as those of the tunnel type for the manufacture of brick and other clay products, the high cost of fuel today is essentially the determining factor whether one can operate at a profit. It is thus of paramount importance that all types of feasible fuels be explored with a view to reducing the attendant cost factor of operation. In recent years in particular, large piles of sawdust that have in the past been viewed as worthless have taken on importance in view of the known fuel value present therein.

While a number of attempts have apparently been made by others to use sawdust as a fuel for operating a kiln, the only known commercial operation involves the pelletizing of the sawdust for conditioning the same for handling, it being well known and recognized that otherwise the green and undried sawdust could not be readily handled or fed in subsequent processing. The pelletized sawdust is then fed into a grinder, after which the sawdust is dried and then fed into a kiln. Such feeding is normally made into the kiln by a gravity feed system. In carefully studying an operation of this type, it was determined that very large sums of money would need to be invested not only in a considerable array of sawdust grading or sorting equipment and the attendant large area to accommodate such sorting equipment, but also the resulting sawdust product presented certain problems. First it was determined that the ground sawdust had long stringy fibers present therein which would not burn easily and would thus lodge or fall on the brick being treated in the kiln and create imperfections thereon in the form of glass-like spots on the brick. Further, it was learned that the pelletizing operation is a relatively costly procedure, considerably reducing the cost advantage in using sawdust instead of normal gaseous fuel for heating the kiln.

With the foregoing in mind, it is a primary object of this invention to provide an apparatus and attendant process for effectively using sawdust as a fuel in the operation of a kiln and wherein the sawdust is dried prior to grinding to present a finer dried product, substantially free of long stringy fibers for more uniform burning of the sawdust and wherein the relatively expensive step of pelletizing the sawdust prior to grinding is avoided by the predried sawdust readily permitting the handling and feeding thereof.

It is a more specific object of this invention to provide in an apparatus and attendant process as described, the using of otherwise exhausted-to-atmosphere waste gas from the kiln to effect the drying of the sawdust prior to the grinding thereof.

It is a more specific object of this invention to provide an improved method and apparatus for preparing and utilizing sawdust as the fuel for a brick tunnel kiln or the like wherein the sawdust is predried and the predried sawdust is fed from a source to a plurality of burners extending into the kiln by directing an airstream into and through each burner and utilizing such airstream to induce a metered amount of sawdust to flow into each burner, with the airstream also providing oxygen for combustion of the sawdust.

According to the invention, heated waste gases are directed from the tunnel of a brick kiln into a dryer for effective drying of sawdust being directed into the dryer. The dried sawdust is then fed from the dryer into a grinding means or hammer mill which reduces the fed dried sawdust to finely divided wood fibers of predetermined maximum size and delivers the same to a storage means. Means are provided for directing an airstream from a source into and through each of a plurality of burner units positioned along the tunnel of the kiln and extending into the tunnel for generating the desired heat for treatment of the brick, and further, means are provided for feeding the dried ground sawdust from the storage means into the airstream in each of the burner units so that the airstream induces the flow of sawdust from the storage means into each of the burner units and also serves to provide oxygen for combustion of the sawdust.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

Figure 1:
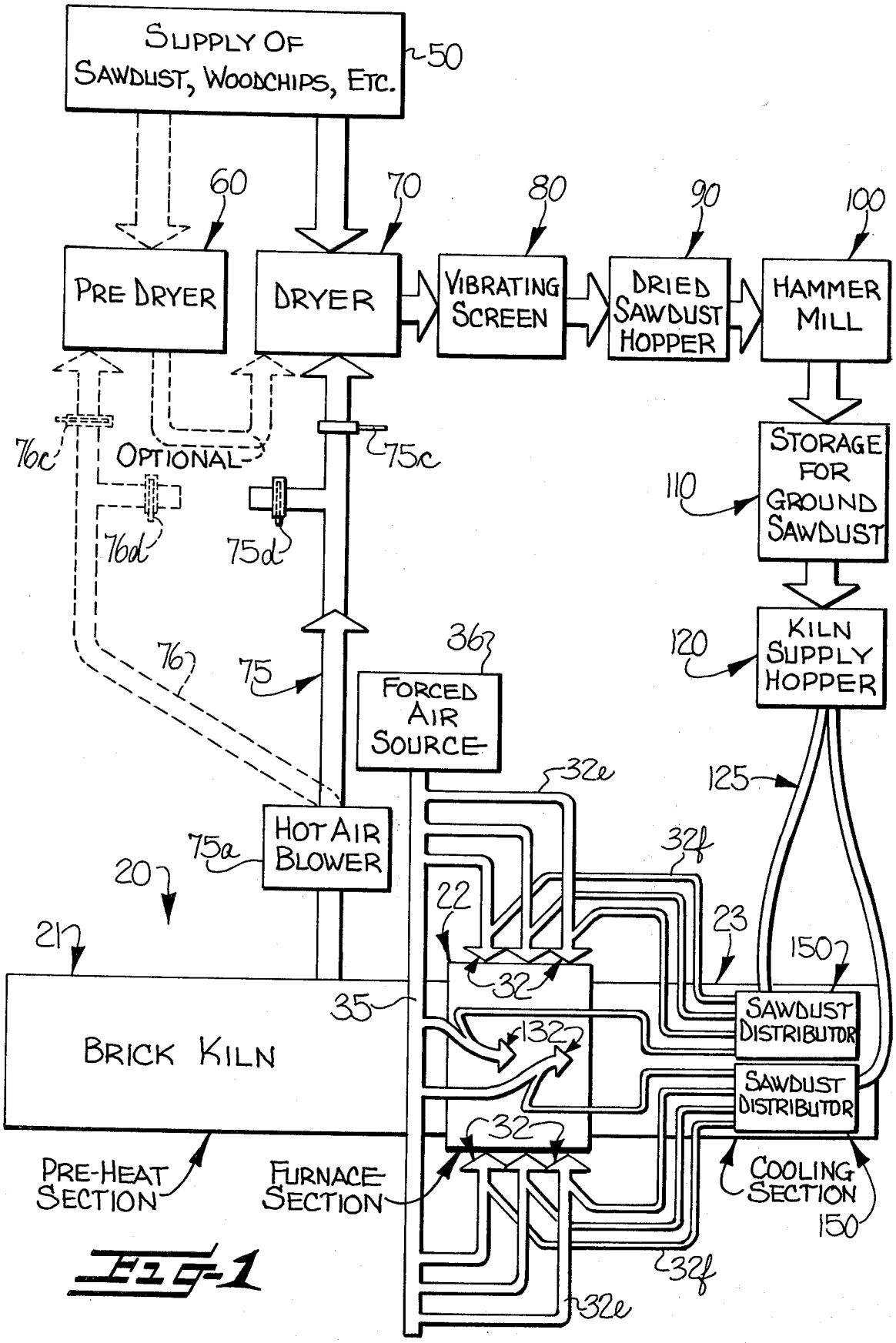
FIG. 1 is a schematic embodiment of the apparatus and system of this invention for preparing sawdust for and feeding sawdust to the furnace section of a tunnel kiln for treating brick.

While this invention will be described hereinafter with particular reference to the accompanying drawings in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

As alluded to above, the present invention is particularly concerned with utilizing dried sawdust for the fuel to heat a tunnel kiln to effect the desired treatment of bricks, and is also concerned with the preparation or conversion of raw or green sawdust into a highly efficient and highly combustible fuel for use in heating a brick kiln without producing undesirable hot spots in the kiln which might cause undue splitting, cracking, distortion, or excessive glass-like hardening of the brick being fired. Accordingly, by way of illustration only, a typical brick kiln or tunnel kiln is shown in FIGS. 1, 2, 7, 10 and 11 and comprises an elongate, open-ended housing broadly designated at 20 and defining a tunnel for the passage therethrough of brick to be treated. In kilns of this type, the brick to be treated is usually stacked on wheeled cars such as that indicated at C in FIG. 11.

The brick kiln 20 includes the usual preheating section 21, furnace section or firing section 22, and cooling section 23 arranged in that order, and each section is provided with opposing side walls 24, 25 and a bridging overhead top wall 26 (FIGS. 2 and 11) which form the housing 20 and define the tunnel.

Figure 2:
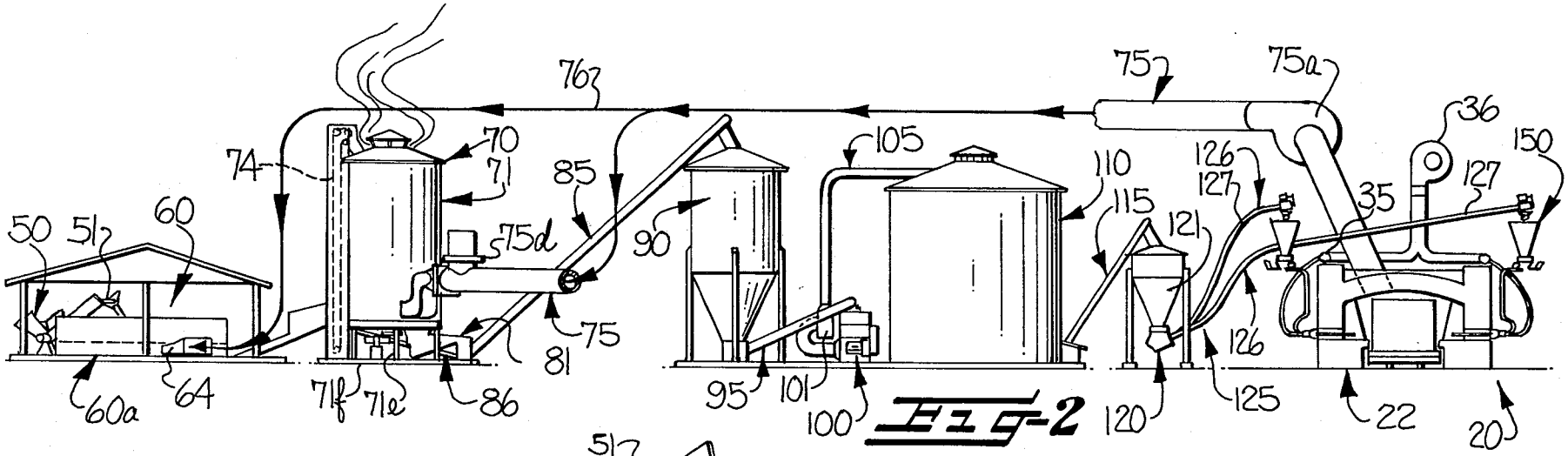
FIG. 2 is a schematic side elevation of the apparatus and system of FIG. 1 showing the preheating section of the tunnel of the kiln in transverse cross-section.
Figure 11:
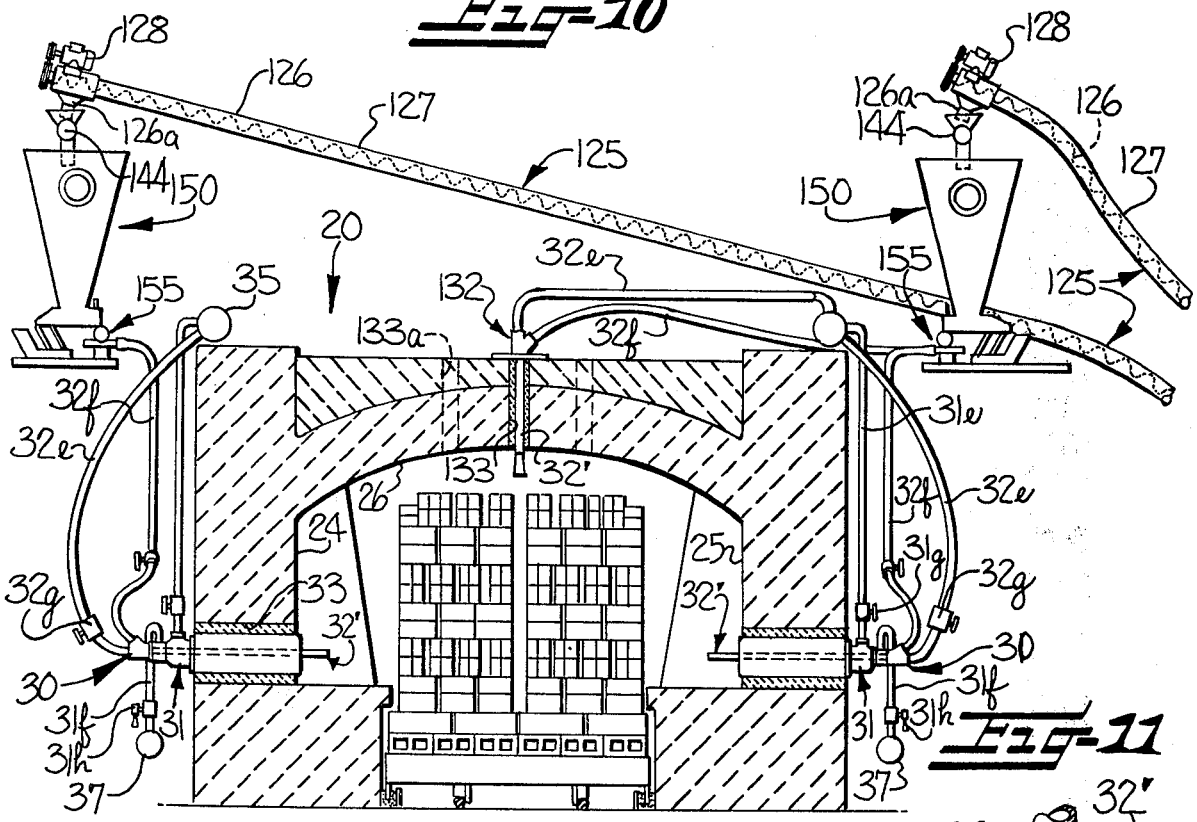
FIG. 11 is an enlarged fragmentary vertical sectional view taken substantially along line 11—11 in FIG. 10.

Heretofore, a conventional furnace section of the type of tunnel kiln shown in FIGS. 2 and 11 has been provided with a plurality of gas burners in the walls 24, 25, 26 thereof. However, according to the present invention, a plurality of specially constructed burner units are particularly provided for burning dried sawdust as the fuel for heating the kiln, and alternatively, with a relatively simple change-over procedure, an operator may convert each of at least some of the burner units for the burning of petroleum gas fuel instead of dried sawdust. Of course, each of the latter burner units may also be readily converted from a gas burner to a sawdust burner, as will be later described.

As best shown in FIG. 11, each of the opposing side walls 24, 25 of the kiln furnace section 22, has a composite burner unit therein, broadly designated at 30, and each of which represents a substantially horizontal row of such burner units 30 positioned along each of the side walls 24, 25 of the furnace section 22 of the kiln housing 20. Each composite burner unit 30 comprises a pair of separable burners or burner units, namely, a gas burner 31 and a sawdust burner 32. Each gas burner 31 is secured to the corresponding kiln side wall, and each sawdust burner 32 is adapted to be secured to and entirely removed from the respective gas burner 31. Accordingly, each gas burner 31 comprises a metal housing 31*a* defining a gas combustion chamber 31*b* therein and secured at one of its ends to the outer end of an elongate tubular ceramic member 31*c*, preferably of refractory material, and which preferably extends entirely through the corresponding kiln side wall 24, 25 and has a longitudinally extending, substantially straight, flame-directing passageway 31*d* therein which extends substantially horizontally entirely through and longitudinally of each respective ceramic member 31*c*.

An air conduit means or delivery pipe 31*e* and a gas conduit means or delivery pipe 31*f* are connected to the gas burner housing 31*a* for communication with the gas combustion chamber 31*b* of the gas burner 31. The pipes 31*e*, 31*f* have respective manually operable control valves 31*g*, 31*h* interposed therein which may be fully opened or partially opened to the desired extent when using the composite burner unit 30 to serve as a gas burner, and during which the flame may be caused to project inwardly to the central portion of the kiln tunnel to the extent desired in accordance with the control afforded by the air flow control valve 31*g*. During use of the composite burner unit 30 as a gas burner, the gas combustion chamber 31*b* is closed at the outer end of the housing 31*a* by a suitable cover plate, not shown, but which cover plate may be secured to the otherwise open outer end of the housing 31*a* of the gas burner 31 by suitable fastening means (FIG. 12), such as screws s. If desired, the fastening means s may be in the form of nuts threaded onto threaded rods or studs projecting outwardly from the outer end of the housing 31*a* of the gas burner 31 and penetrating the cover plate last mentioned.

As indicated above, when the composite burner unit 30 is being used as a gas burner, the sawdust burner 32 is separated from the gas burner 31, and the control valves 31*g*, 31*h* are opened to the desired extent to obtain the desired combustion as the petroleum gas and air flow into the housing 31*a* and along the passageway 31*d* in the ceramic support member 31*c* to project the flame produced by the burning gas into the tunnel of the kiln in the desired direction and for the desired distance. As shown in FIG. 11, the side walls 24, 25 of the furnace section 22, and portions of the side walls 24, 25 of the adjacent end portion of the preheating section 21 of the kiln housing 20 (see FIG. 10), are each provided with a substantially horizontally arranged row of openings 33 therethrough, one for each of the composite burner units 30. Each of the openings 33 has one of the tubular ceramic members 31*c* extending therethrough in substantially sealing relation to the corresponding side wall of the kiln housing 20.

At this point, it is believed helpful to describe a typical arrangement of and the operation of a plurality of petroleum gas burners in a typical kiln. In such a typical kiln, the furnace section was about 45–50 feet long and had a row of eleven gas burners substantially equally spaced apart along each side wall 24, 25 of the furnace section 22. Six additional spaced-apart gas burners were provided in the end portion of each side wall 24, 25 of the preheating section 21 adjacent the furnace section 22. Further, a row of six spaced-apart, downwardly facing gas burners were provided in adjacent portions of the top walls 26 of the preheating and furnace sections 21, 22 of the kiln. Thus, it can be seen that the typical kiln was equipped with forty gas burners.

During normal operation of the forty gas burners of the typical kiln, it was not unusual to have all the gas burners operating simultaneously for several months at a time. Thus, it can be appreciated that very large volumes of petroleum gas are consumed in the operation of a brick kiln.

It has been determined that, under the present economic conditions, the cost per therm of petroleum gas is about 2½ times greater than that of sawdust which has been dried and sized in accordance with the present invention, as will be later described. Thus, it can also be appreciated that substantial savings in cost of fuel may be realized by providing sawdust which is of such particulate size and of such minimal moisture content as to be useful as a highly combustible particulate fuel, and by providing burner units capable of burning such sawdust efficiently.

Accordingly, the sawdust burners 32 of the burner units 30 are, per se, peculiar to the present invention, and each of the sawdust burners comprises an elongate flame-projecting pipe 32' which may be of one-piece construction, if desired, but which is preferably formed of a pair of axially aligned pipe sections **32*a*, 32*b* which collectively extend from the outer end of the gas burner housing 31*a*, entirely through the gas burner housing 31*a* and the ceramic member 31*c*. As preferred, the free end of the pipe section 32*b* terminates beyond the ceramic member 31*c* and within the corresponding portion of the tunnel of the kiln. Preferably, the pipe section 32*a* is somewhat longer than the pipe section 32*b*** and is formed of a relatively low-grade metal, such as wrought iron or low-carbon steel.

The proximal ends of the aligned pipe sections **32*a*, 32*b* are suitably interconnected, as by being welded together, and the free end pipe section 32*b* preferably is made from stainless steel tubing so as to better withstand the high temperatures within the kiln tunnel without becoming burned away as quickly as would be the case were the entire pipe structure of the sawdust burner 31 formed of a low-grade material. On the other hand, it is desirable that the section 32*a* be made from a low-grade material for the sake of economy in manufacture of the sawdust burner 32**.

Figure 12:
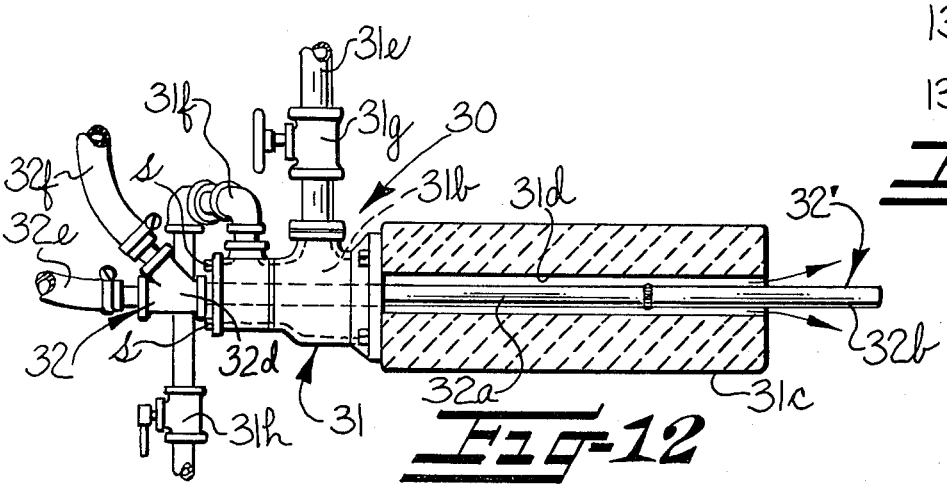
FIG. 12 is an enlarged elevation of one of the fuel burner units, such as that shown in the left-hand portion of FIG. 11, but wherein the ceramic sleeve surrounding the major portion of the flame projector tube of the sawdust burner is shown in cross-section.

Welded or otherwise suitably secured to the outer end portion of the section **32*a* of the flame-projecting pipe 32' is a flange or plate 32*c* through which the pipe section 32*a* extends, and during use of the burner unit 30 as a sawdust burner, the flange 32*c* is secured, as by the fastening means s, heretofore described, to the outer end of the housing 31*a* of the gas burner 31, with the tube sections 32*a*, 32*b* occupying the substantially horizontal position shown in FIG. 12. In this regard, it will be noted that the external diameter or cross-sectional area of the pipe sections 32*a*, 32*b* is somewhat less than the internal diameter or cross-sectional area of the passageway 31*d* in ceramic member 31*c*, and through which the pipe sections 32*a*, 32*b* extend. Thus, although the valve means 31*h* of the corresponding gas pipe or conduit 31*f* will be closed whenever the sawdust burner 32 is being used, the valve 31*g* of FIG. 12 may be opened so that air flowing therethrough and through conduit 31*e* and into the housing 31*a* of the gas burner 31 will flow along the outside surfaces of the pipe sections 32*a*, 32*b* as it flows through the passageway 31*d* in the ceramic member 31*c* for thereby cooling the pipe sections 32*a*, 32*b* to some extent and thus extending the useful life of the pipe section 32*b* when the sawdust burner 32 is being used for heating the kiln. The air stream thus introduced into the kiln tunnel via the respective conduits 31*e* also supplies oxygen for aiding in burning the sawdust being introduced into the kiln via the sawdust burners 32**.

In accordance with this invention, means are provided for directing an air stream from a source into and through each of the sawdust burners 32 and for directing dried, ground sawdust from a source into the air stream in each of the sawdust burners 32 so that the air stream induces the flow of sawdust from the source of sawdust into each of the burners 32 and also serves to provide oxygen for the combination of the sawdust. To this end, the outer end of each flame-projecting pipe 32', i.e., the outer end of each pipe section **32*a*, has an aspirator means 32*d*** communicatively connected thereto.

As illustrated in FIG. 12, the aspirator means **32*d* may take the form of a pipe fitting or pipe tee with a branch portion thereon extending at an angle preferably upwardly and outwardly away from the major portion of the flame-projecting pipe 32'. The outer end of the pipe fitting or aspirator 32*d* has an air conduit means or pipe 32*e* detachably connected thereto, and the branch portion of the aspirator 32*d* has a sawdust-conveying feed conduit means or pipe 32*f* detachably connected thereto. Preferably, each of the pipes 32*e*, 32*f* is made from a flexible material and is clampingly connected to the sawdust burner 32 (see FIG. 12) so that they may be readily removed from the gas burner 31 whenever the sawdust burner 32 is to be separated from the gas burner 31**.

When the kiln has been shut down for any reason and is thus at a relatively cool temperature, it then may be heated initially by utilizing some or all of the burner units 30 as gas burners 31. For example, alternate burner units 30 in each row along the side walls 24, 25 of the kiln furnace and pre-heating sections 22, 21 (FIGS. 10 and 11) may have the respective sawdust burners 32 removed therefrom simply by removing the fastening means s (FIG. 12) from the respective gas burner housings **31*b* and then withdrawing the flame-projecting pipe 32' from the ceramic member 31*c* and the housing 31*b* of the respective gas burner 31, and then securing the aforementioned closure plate, not shown, against the outer end of the gas burner housing 31*b* in place of the plate 32*c*. Thereafter, the control valves 31*g*, 31*h* may be opened and the gas ignited in the gas burner housings 31*b* from which the sawdust burners 32** have been removed.

During the initial heating of the kiln furnace and preheating sections 22, 21 by the aforementioned alternate burner units 30 having thus been converted to gas burners 31, the intervening gas burners 31, which may still have the respective sawdust burners 32 assembled therewith, may remain inactive until at least the furnace section 22 of the kiln has been heated to at least a minimum temperature sufficiently high, e.g., at least about 400° F., so as to quickly ignite any sawdust subsequently introduced into the furnace section 22. If desired, the temperature in the furnace section 22 at this time may have been brought up to its operational temperature of about 2000° F. In any event, after a desired sawdust igniting temperature is reached in the furnace section 22 of of the kiln, the gas control valves **31*h* in those gas pipes 31***f* associated with the aforementioned alternate burner units 30 are closed to shut off the flow of petroleum gas to the respective gas burners 31. Thereupon, those sawdust burners 32 previously removed from the alternate gas burners 31 may be assembled with the alternate gas burners in the manner of the sawdust burner 32 shown in FIG. 12, and the activating of the sawdust burners may be effected by opening manual control valves 32*g* provided in the respective air pipes 32*e* to admit airstreams and sawdust, via the respective pipes 32*e*, 32*f*, into the respective sawdust burners 32. It is apparent that the sawdust thus being propelled into the kiln will be ignited upon entering the previously heated sections of the kiln. As will be further explained hereinafter, the air being admitted into the aspirators of the sawdust burners 32 induces the flow of sawdust into the burners.

Thus, it can be seen that all the composite burner units 30 may be used as sawdust burners while the temperature in corresponding portions of the kiln is sufficiently high to ignite the sawdust being directed into the kiln by any of the sawdust burners 32.

Depending upon the type of brick being treated, there are occasions when it may be desirable to have some of the composite burner units 30 in the side walls 24, 25 of the kiln housing 20 serve as gas burners while others of the composite burner units 30 serve as sawdust burners. It is apparent that such arrangements of the gas burners 31 and the sawdust burners 32 are facilitated by the ease with which the composite burner units may be converted from gas burners to sawdust burners or from sawdust burners to gas burners, as the case may be.

Although separate pipes or conduits 31*e*, 31*f*, 32*e*, 32*f* are provided for each of the burner units 30, it will be observed in FIG. 11 that the air pipes 31*e*, 32*e* of all the burner units 30 at any given side of the kiln may be connected to a common air distributor pipe 35, there being one of the distributor pipes 35 provided adjacent each side of the kiln and both of them being connected to the high-pressure or exhaust side of a fan or turbine shown schematically at 36 in FIG. 2. The gas pipes 31*f* associated with the burner units 30 adjacent each respective side wall of the kiln may be connected to a common branch pipe 37 connected to a suitable source of petroleum gas, not shown.

In most instances, it is desirable to provide means for directing a fuel into the upper central portions of a kiln furnace section. Accordingly, it will be observed in the upper central portion of FIG. 11 that the upper or top wall 26 of the kiln furnace section 22 has a vertically extending opening 133 therethrough for receiving therein a sawdust burner or burner unit broadly designated at 132 and which may be of substantially the same construction as the sawdust burner unit 32 shown in FIG. 12. However, it will be noted that, while a gas burner may be provided, if desired, in association with the sawdust burner 132, the use of a gas burner generally is unnecessary in combination with the sawdust burner 132, since the ignition of the sawdust entering the kiln via the sawdust burner 132 can be readily effected after the furnace section has been heated to the required temperature by the gas burners 31 of the burner units 30 in the side walls of the furnace section 22 and/or the preheating section 21 of the kiln housing 20.

Referring again to the sawdust burner unit 132 in the upper central portion of FIG. 11, this burner unit 132 also represents a row of a plurality of similar burner units positioned in the top wall 26 of the furnace section 22 of housing 20. In fact, if desired, additional sawdust burner units similar to the burner unit 132 may be positioned to either side or both sides of the burner unit 132 shown in FIG. 11, if desired, by providing additional substantially vertical passageways 133*a* through the upper wall 26 to one side of the passageways 133, and filling such passageways 133*a* with a suitable filling material, not shown, which may be readily removed from such passageways 133*a* in the event that a sawdust burner is to be inserted therein in the manner of the sawdust burner 132 of FIG. 11. In this regard, since the sawdust burner 132 may be substantially the same as that sawdust burner 32 shown in detail in FIG. 12, with the exception of being separated from any gas burner 31, those parts of the sawdust burner 132 shown in FIGS. 11 and 13 which correspond to like parts shown in FIG. 12 will bear the same reference characters, where applicable, in order to avoid repetitive description. It will be noted that a suitable sealing material 134 is provided in the passageway 133 of FIG. 11 so that the flame-projecting pipe 32' of the sawdust burner unit 132 is in substantially sealing relation to the upper wall 26 of the furnace section 22 of the kiln housng 20.

Figure 13:
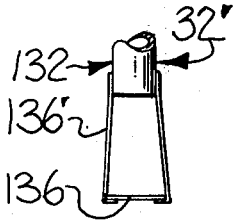
FIG. 13 is a fragmentary view of the lower, sawdust egress end of the vertically positioned flame projector tube of one of the sawdust burner units mounted in the upper wall of the brick kiln, such as that shown in the upper central portion of FIG. 11.

As can be seen in FIGS. 11 and 13, the gas burner 132 differs from the gas burner 32 of FIG. 12 in that a deflector plate or baffle 136 is spaced a relatively short distance of, say, six inches, away from the free open end of the flame-projecting pipe 32' of the sawdust burner 132 and is attached to the latter flame-projecting pipe 32' as by means of spaced arms 136' welded or otherwise suitably secured to the flame-projecting pipe 32' and the baffle 136. The baffle 136 is provided to aid in distributing the sawdust about the upper portion of the furnace section 22 of the kiln housing 20 as it is being discharged from the open lower end of the flame-projecting pipe 32' of each sawdust burner 132.

The manner in which sawdust is prepared for being fed to the burners 32, 132 in accordance with this invention will now be described.

While large quantities of sawdust are readily available in certain areas of the United States of America, especially in the southeastern states, it has not served as an entirely satisfactory fuel for kilns heretofore due, primarily, to large amounts of moisture normally being present in the sawdust. According to the present invention, virtually all the moisture is removed from wet or raw sawdust, such as green sawdust, after which the dried sawdust is ground to reduce the sawdust, including any relatively large particles, chips, and chunks therein, to finely divided wood fibers of predetermined maximum size.

As shown in FIGS. 1 and 2, raw sawdust is directed from a supply source 50 directly into a dryer 70 or, if desired, into a predryer 60 and from the predryer into the dryer 70. Optionally, the dried sawdust from the dryer 70 may pass over a vibrating screen 80 in its course to a dried sawdust hopper 90, or if desired, the dried sawdust may be conveyed directly from the dryer 70 into the hopper 90. The vibrating screen 80 may be desirable in processing sawdust containing substantial amounts of sand, so that the sand may be sifted from the sawdust before the sawdust is introduced into the sawdust burners 32, 132 (FIGS. 11 and 12). The presence of large amounts of sand in the dried sawdust fuel might present a problem in the removal of such sand from the kiln. Also, sand particles entering the furnace section 22 would likely be melted and thus might adhere to and thereby have deleterious effects on the brick being fired.

Referring again to FIGS. 1 and 2, it will be observed that the dried sawdust received in the hopper 90 is then advanced to a grinding station or hammer mill 100 which grinds the dried sawdust and reduces the same to finely divided wood fibers of predetermined maximum size. Thereafter, the sawdust from the hammer mill 100 is conveyed into a storage bin or housing 110 for intermediate storage of the dried sawdust in quantities substantially greater, for example, than a single day's production of dried sawdust by the dryer 70.

As needed, dried sawdust is conveyed from the large storage bin 110 into a kiln supply hopper 120 from whence the dried sawdust is conveyed into a plurality of sawdust distributors 150, each of which has a plurality of the aforementioned sawdust feed pipes **32*f* connected thereto for feeding dried sawdust to the respective sawdust burners 32 and 132 (FIGS. 2, 11, and 12) when the valves 32*g* of respective air pipes 32*e*** are opened.

The predryer 60, the dryer 70, the sawdust distributors 150, and intervening components between the dryer 70 and the sawdust distributors 150 will now be described more in detail.

Figure 3:
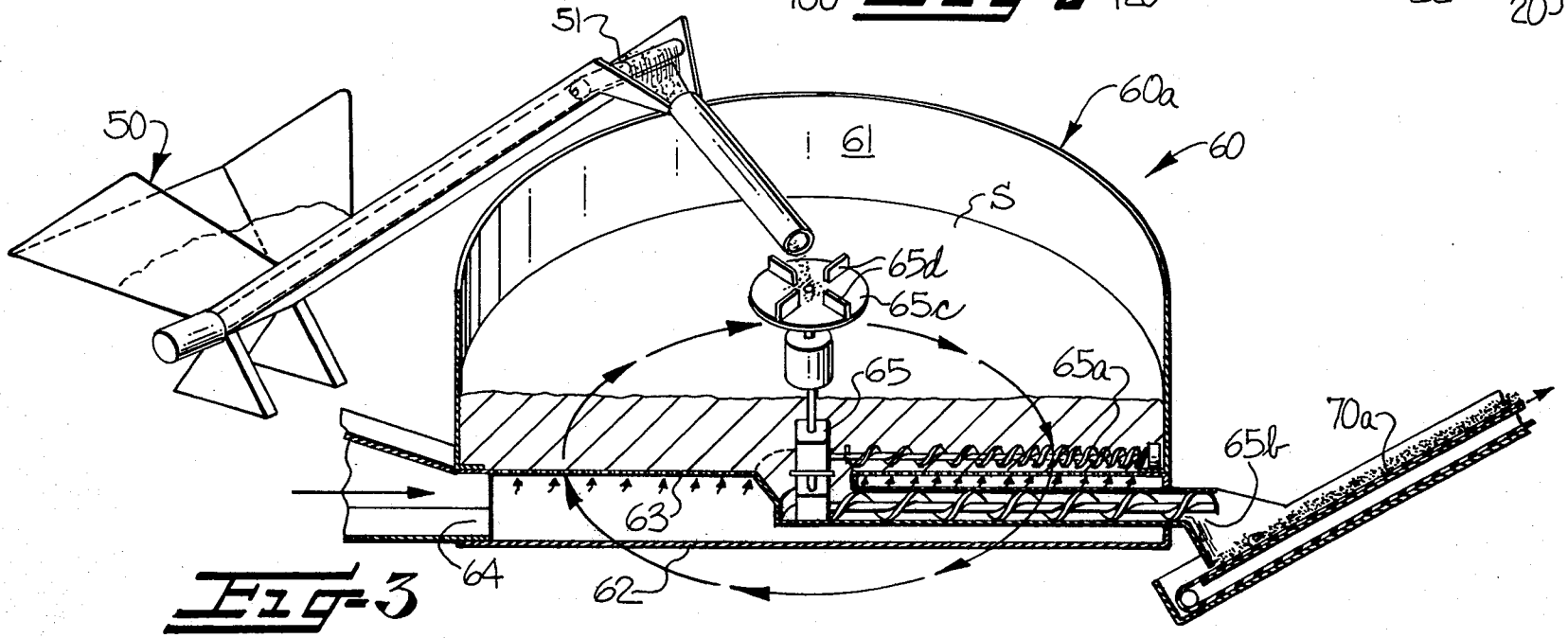
FIG. 3 is a pictorial view of the sawdust predryer shown in the left-hand portion of FIG. 2, partially in section and with parts broken away.

Referring now to FIG. 3, it will be observed that the predryer 60 is generally in the form of a substantially circular, open-topped bin having a substantially circular upright wall 61, a main bottom wall 62, and an intermediate bottom wall 63. The intermediate bottom wall 63 is perforated so that heated air entering the space between the lower and upper bottom walls 62, 63 through a hot air inlet or opening 64, in side wall 61, may flow upwardly through the wet sawdust S previously deposited upon the perforate intermediate bottom wall 63 from the source 50. In this instance, the source 50 is shown provided with a suitable conveyor means 51 in association therewith for transferring sawdust from the source of supply 50 into the bin of the predryer 60. A suitable motor 50 is mounted in a central portion of the predryer bin 60 and drives a sweep auger **65*a* and a bin-unloading auger 65*b* extending substantially horizontally above and below, respectively, the intermediate perforated bottom wall 63 of the predryer 60. The motor 65 also drives a distributor member or plate 65*c* positioned on a substantially vertical axis and having a plurality of spaced deflector elements 65*d* thereon for deflecting the sawdust outwardly as it is deposited on the plate 65*c* by the feed conveyor means 51 to thereby distribute the sawdust within the bin of the predryer 60**.

It is preferred that only a relatively shallow layer of wet sawdust, about 18 inches thick, is deposited in the predryer bin, in order that the air flowing upwardly through the intermediate bottom wall 63 may be of sufficient force to substantially penetrate through the layer of sawdust, but not of such force that it would unduly disturb the sawdust and cause it to become airborne to such extent as to be blown out of the relatively shallow bin **60*a* of the predryer 60**.

The conveyors or augers **65*a*, 65*b* may be of essentially the same construction as the sweep auger and the bin-unloading auger shown and described in Shivers U.S. Pat. No. 3,563,399, to which reference is made for a more detailed description thereof. Accordingly, a further more detailed description of the predryer 60 is deemed unnecesary. It will be noted that the bin-unloading conveyor or auger 65*b* in FIG. 3 extends through the side wall 61 of the bin of the predryer 60 so that the sawdust being removed from the predryer 60 is deposited upon the upper run of an endless belt type of conveyor 70*a* which is inclined upwardly and forwardly for feeding any partially dried sawdust from the predryer into the dryer 70. As heretofore indicated, the predryer 60 is an optional feature of the invention and, when the predryer 60 is not being used, or in the absence of a predryer, the sawdust is received directly from the source of supply 50 onto the feed conveyor 70*a* for feeding the sawdust to the dryer 70** which will now be described in detail.

Figure 4:
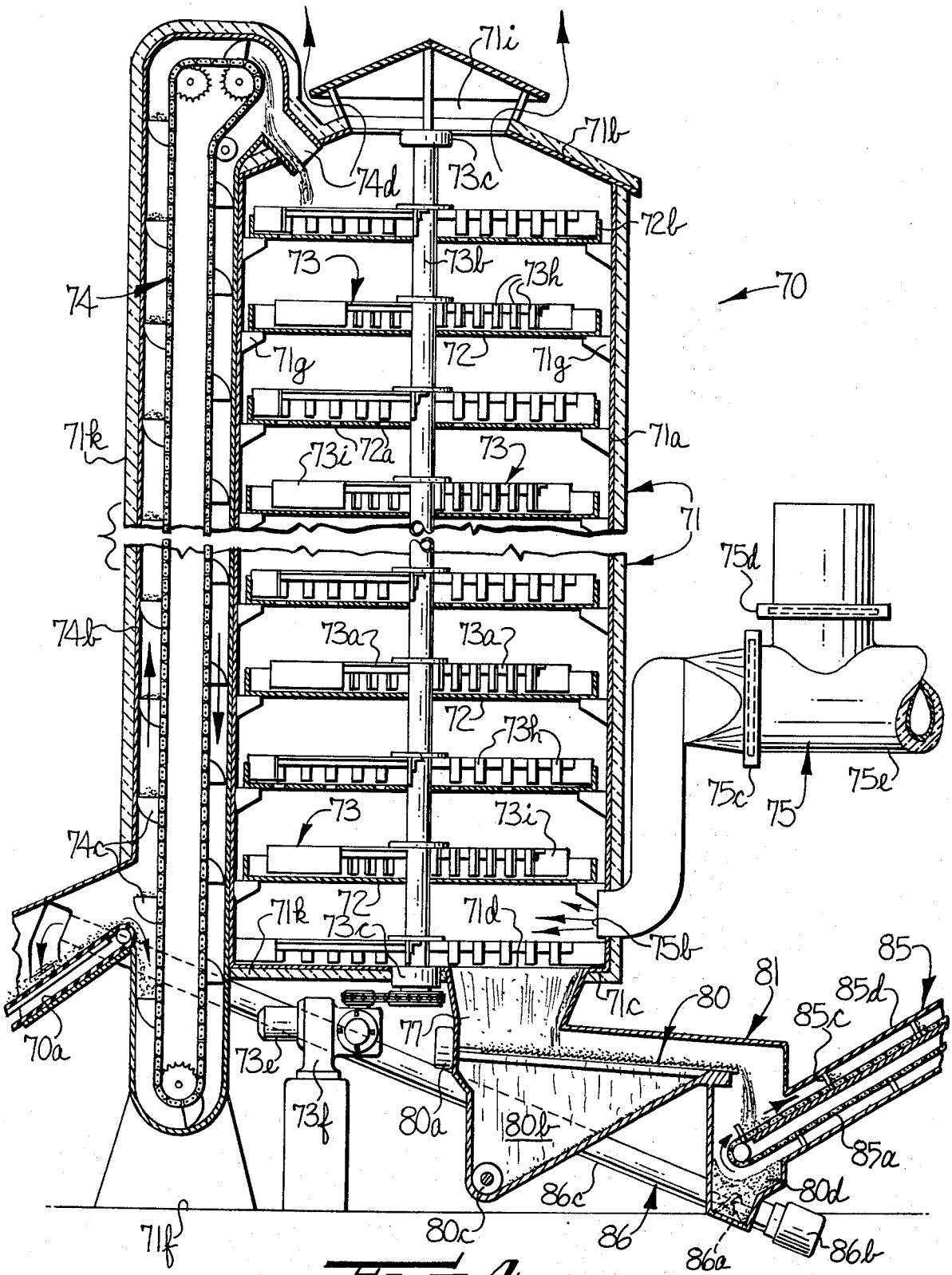
FIG. 4 is an enlarged vertical sectional view through the sawdust dryer shown in the medial left-hand portion of FIG. 2, but showing the hot air inlet for the lower portion of the dryer about 90 degrees out of position for purposes of clarity.

Referring to FIGS. 2 and 4, it will be observed that the dryer 70, which also may be termed as a dryer apparatus, comprises an upright housing 71 which is preferably substantially circular in plan and includes a substantially circular upright side wall **71*a*, and a substantially horizontally disposed bottom wall 71*c* having a sawdust discharge or egress opening 71*d* therein. The upright housing 71 of dryer 60 is supported on suitable legs 71*e* (FIG. 2). The bottoms of the legs 71*e* may rest upon a suitable concrete base 71*f***.

The upright housing 71 has a plurality of vertically spaced, substantially horizontal metal dryer plates 72 therein, each of which is of a somewhat lesser external diameter than the internal diameter of the substantially circular side wall **71*a* of the dryer 70 so that heated air may flow upwardly from the lower portion of the housing 71 between the edges of the plates 72 and the circular wall 71*a*. Preferably, the side wall 71*a* and the bottom wall 71*c*** are also made of metal.

Figure 5:
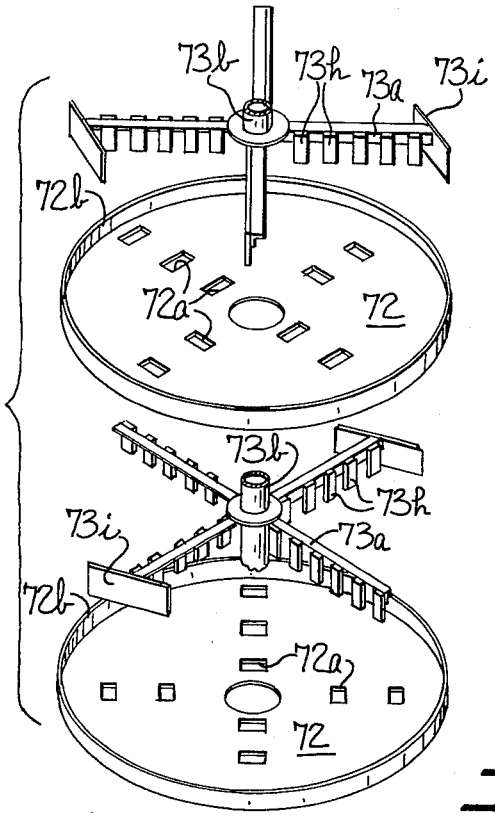
FIG. 5 is a partially exploded perspective view of some of the sawdust agitating elements within the housing of the dryer shown in FIG. 4.
Figure 6:
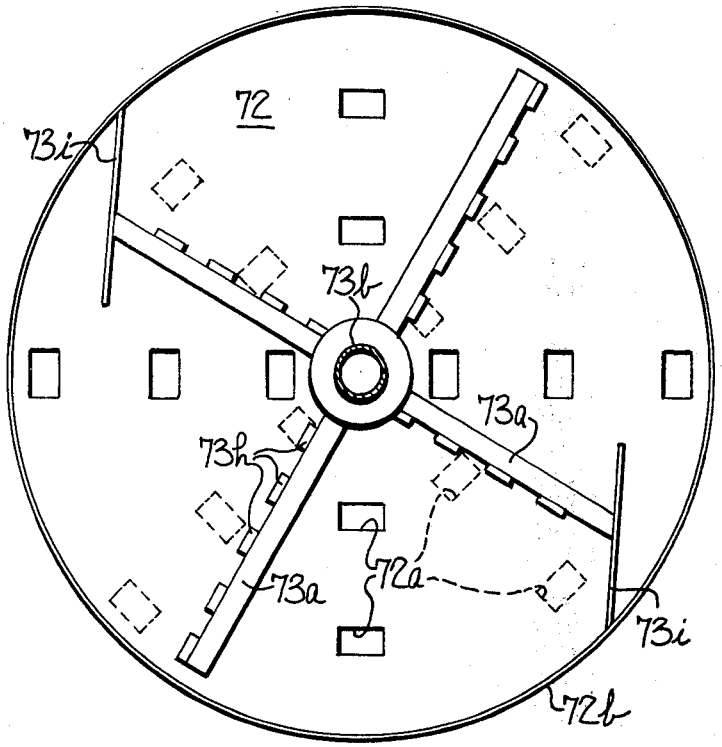
FIG. 6 is an enlarged plan view of one of the sawdust treating platforms or plates shown within the housing of the dryer in FIG. 4, and showing the sawdust agitating and distributing arms associated therewith.

As best shown in FIGS. 5 and 6, the plates 72 have a plurality of openings in each quadrant thereof through which sawdust introduced at the top of the housing 71 may successively pass downwardly to and through the plates 72, and it will be noted that the openings **72*a* in adjacent plates 72 are staggered relative to each other so that the sawdust from one plate 72 may not drop downwardly through an opening 72*a* thereof into an opening of the next lower plate and so that the sawdust moves downwardly in a sinuous path through the upright housing 71. The plates 72 and the bottom wall 71*c* of the dryer housing 71 are made from metal so that they will absorb heat from the heated air flowing thereby and will thus conduct heat to the sawdust being received thereon and will also radiate heat to the sawdust to enhance the drying of the sawdust as it migrates toward the bottom of the housing 71. The metal side wall 71*a*** also absorbs and radiates heat to aid in drying the sawdust.

Each of the metal dryer plates 72 is supported on a plurality of brackets **71*g* carried by and projecting inwardly from the cylindrical or circular side wall 71*a* of the housing 71, and upright rim means 72*b* is connected to peripheral portions of each of the dryer plates 72 and serves for preventing the sawdust from moving outwardly off the plates 72. Sawdust agitator means 73 (FIGS. 4–6) are associated with the respective dryer plates 72 and the bottom wall 71*c* of the upright housing 71. Each agitator means 73 comprises a plurality of substantially horizontal rotating arms 73*a* rotatable on a vertical axis and extending outwardly in overlying relation to each of the respective plates 72 and the housing bottom wall 71*c*. In this instance, the outwardly extending arms 73*a* have their inner ends welded or otherwise suitably secured to a vertically disposed, preferably hollow, shaft 73*b* whose upper and lower end portions are suitably journaled, as at 73*c* (FIG. 4), in upper and lower portions of the housing 71**. The lower end of the shaft 73*b* is connected to an electric motor 73*e*, via a gear reduction unit 73*f* (FIG. 4) for rotating the agitator arms 73*a* at a relatively slow rate of speed about the substantially vertical axis defined by the shaft 73*b*.

Each of the rotating arms 73*a* has a plurality of longitudinally spaced depending teeth or teeth means 73*h* thereon which extend downwardly from all the arms and terminate in closely spaced relationship to the respective underlying plates to serve for agitating the sawdust for enhancement of the drying thereof on the plates 72. As best shown in FIGS. 5 and 6, there are four circularly spaced agitator arms 73*a* above each metal dryer plate 72 and the metal bottom wall 72*c* of housing 71, with the arms 73*a* of each agitator means 73 being spaced substantially equidistantly about the axis of the substantially upright shaft 73*b*. However, it is preferred that the arms 73*a* of alternate ones of the agitator means 73 are positioned in offset relation with respect to the adjacent arms 73*b* of the intervening sawdust agitator means 73 between the aforementioned alternate agitator means 73. Also, the teeth 73*h* on one arm 73*a* are staggered relative to the teeth 73*h* on the next adjacent arm 73*a* overlying the same dryer plate 72 (or the bottom wall 71*c*) so as to impart increased agitation to the sawdust on the respective plate as the arms rotate thereabove.

Means are provided for engagingly deflecting the sawdust resting on the metal dryer plates 72 inwardly toward the axis of the arms 73*a* to further enhance the drying of the sawdust. To this end, the outer ends of at least certain of the arms 73*a*, e.g., two diametrically opposite arms 73*a* in this instance, of each sawdust agitator means 73 are provided with respective forwardly and radially outwardly angled deflector plates 73*i* welded or otherwise suitably secured thereto. The outermost portions of the deflector plates 73*i* terminate inwardly of and closely adjacent the respective upright rim means 72*h* (FIG. 6). Thus, during rotation of the agitator arms 73*a*, it is apparent that the deflector plates 73*i* deflect the sawdust resting on the respective underlying plates 72 toward the axis of the arms 73*a* and into the paths of the teeth means 73*h* depending from the respective agitator arms 73*a*.

In order to introduce the sawdust at the top of the housing 71, an upright endless conveyor means 74 (FIG. 4), preferably a bucket conveyor, is mounted exteriorly of, along one side of, and extends substantially the full height of the dryer housing 71. The conveyor means 74 may be driven by any suitable means, such as an electric motor 74*a* (FIG. 4), and is housed in an upright enclosure 74*b* carried by the dryer housing 71. It will be observed in the left-hand lower portion of FIG. 4 that the discharge end of the upper flight of the feed conveyor means 70*a* extends into a lower portion of the conveyor enclosure 74*b* so that the sawdust received on the conveyor 70*a* is discharged therefrom into the successive buckets 74*c* of the upright endless conveyor means 74. As each successive bucket 74*c* reaches the uppermost portion of the bucket conveyor means 74, it is inverted and the contents thereof are emptied through an opening or passageway 74*d* onto the uppermost metal dryer plate 72 in the dryer housing 71.

To ensure effective drying of the sawdust as it moves downwardly through the housing 71, air inlet means 75*b* is provided for permitting introduction of hot dry air into the dryer adjacent the lowermost dryer plate 72 so that the air may then flow upwardly through the staggered openings 72*a* in the plates 72 in a sinuous manner.

Since it is desirable to maintain the air in the dryer housing 71 at the highest temperature to which the sawdust may be subjected without carbonizing or burning the sawdust in the dryer 70, it is advantageous to direct heated waste gases or air from a hot area of the kiln housing 20 into the sawdust dryer housing 71. Accordingly, since the air in the preheating section 21 of a typical brick kiln is approximately 1300° F., it will be observed in FIG. 1 that a duct means 75 is communicatively connected to the kiln preheating section 21, preferably at a location remote from the portion thereof where the burner units 30 are positioned. The duct means 74 extends from the preheating section 21 of the brick kiln to the dryer 60 and has a hot air blower 75*a* interposed therein to cause the air from the kiln to flow into the lower portion of the dryer housing 71. In this regard, it will be observed in the lower portion of FIG. 4 that the discharge end of the duct means 75 enters the lower portion of the housing 71 through the side wall 71*a* to define the air inlet means 75*b* closely adjacent and above the bottom wall 71*c* of the housing 71. Of course, the air inlet means 75*b* also is disposed beneath the lowermost dryer plate 72 for introducing the hot dry air into the dryer 70 adjacent the lowermost dryer plate so that the air then may flow upwardly through the staggered openings 72*a* in the plates 72 in a sinuous manner, as heretofore indicated.

Since the temperature of the hot dry air being conveyed along the duct means 75 may be so high as to carbonize or burn the sawdust being treated in the housing 71, a control valve or damper 75*c* is interposed in the duct means 75 downstream of and adjacent an ambient air inlet control valve means 75*d* (FIG. 4). The ambient air inlet valve means 75*d* may be opened to the desired extent to permit sufficient ambient air to enter the duct means 75 for cooling the same to the desired temperature for properly drying the sawdust in the housing 71. Additionally, the damper 75*c* may be adjusted to regulate the rate of flow of the hot dry air from the preheating section 21 of the brick kiln into the dryer housing 71. Also, the control valve 75*c* may be closed, and the ambient air inlet control valve 75*d* may be fully opened when the operation of the dryer 70 must be interrupted and/or a substantial reduction in the temperature of the air and surfaces within the dryer housing 71 may be desired for any reason. It is apparent that, when the valve 75*c* is fully closed and the valve 75*d* is open, the hot air may bypass the dryer 70 and be exhausted from the duct means through the valve 75*d* to the ambient atmosphere.

It will be noted that the roof or upper wall 71*b* is provided with a vent 71*i* to permit the hot dry air being introduced into the lower portion of the dryer housing 71 to flow upwardly past and through all the plates 72 and to be exhausted from the upper portion of the housing 71.

Since it is desirable to maintain a temperature of about 350° to 400° F. within the housing 71 of the dryer 70 during normal operation of the dryer, it is preferred that the exterior surfaces of the side wall 71*a*, the top wall 71*b*, and the bottom wall 71*c* of the dryer housing 71, as well as the exterior surfaces of the conveyor enclosure 74*b*, are covered with a suitable thermal insulation material 71*k*. The duct means 75 also may be covered with a suitable thermal insulation material 75*e*.

As shown in FIG. 1, when the optional predryer 60 is provided, as heretofore described, a branch duct means 76, shown in phantom lines, then may extend from the duct means 75 at the exhaust side of the hot air blower 75*a* to the hot air inlet 64 (FIG. 3) of the predryer 60. The branch duct means 76 may be provided with control valves 76*c*, 76*d* for controlling the flow of hot dry air to the predryer 60 in essentially the same manner as, and in cooperation with, the control valves 75*c*, 75*d*.

Referring again to FIG. 4, it will be observed that the sawdust discharge outlet 71*d* in the bottom wall 71*c* of the dryer housing 71 defines the upper end of a well means 77 within which the receiving rear end portion of the filter or screen 80 is positioned, in this instance. Thus, the well means 77 is formed as a portion of a screen-supporting housing broadly designated at 81. The screen 80 is supported in a substantially horizontal or slightly forwardly and downwardly inclined position in the screen housing 81 and may be vibrated at the desired frequency by a suitable electric vibrator means 80*a*. Since vibrating screens and filters are well known in the art, a further more detailed illustration and description of the vibrating filter or screen 80 is deemed unnecessary.

It is to be noted, however, that the openings in the vibrating screen 80 should be of such size that only very small particles, such as sand particles, will pass through the screen 80 into the collection chamber 80*b* defined by the lower rear or left-hand portion of the screen housing 81 in FIG. 4. A suitable conveyor means 80*c*, such as an auger, may be provided for periodically emptying the sand collected in the collection chamber 80*b* of the housing 81. The vibration imparted to the vibrator 80*a* causes the sawdust received on the rear portion of the screen 80 to advance forwardly and drop into a second well means 80*d* defined by a forward portion of the screen housing 81.

As the dried and thus cleaned sawdust drops off the forward edge of the screen 80 and into the well means 80*d*, the sawdust drops onto the rear portion of an upwardly and forwardly inclined transfer conveyor means 85 whose upper portion is arranged for delivering the dried sawdust into the dried sawdust hopper 90, as shown in FIG. 2. The conveyor means 85 may be of any desired construction and is shown in the form of an endless chain 85*a* (FIG. 4) having a plurality of spaced transverse flight bars 85*b* thereon which pass immediately above an inclined support member 85*c* carried by a housing 85*d* within which the endless conveyor chain 85*a* is positioned. The conveyor means 85 may be driven by any suitable means such as an electric motor 85*e* (FIG. 4). The endless conveyor chain 85*a* may take the form of a so-called drag chain whose flight bars 85*b* move relatively close to or against the upper surface of the support member 85*c* so that the sawdust is supported on the support member 85*c* as the flight bars propel the sawdust upwardly to the inlet in the upper end of the hopper 90.

Experiments in the use of the ground, dried sawdust as a fuel for the sawdust burners 32, 132 (FIGS. 11 and 12) have indicated that, desirably, the amount of moisture remaining in the same in accordance with this invention, should be no more than about 12 percent by weight. Occasionally, however, it may happen that sawdust that has passed through the housing 71 of dryer 70 has not been dried to the desired extent. To rectify such a situation, means are provided for selectively recirculating sawdust from the lower end of the housing 71 back to the top of the housing so that the sawdust can again pass downwardly through the dryer plates 72 for effecting further drying of the sawdust. To this end, such recirculating means includes an additional conveyor means 86 (FIGS. 2 and 4) associated with the well means 80*d* and extending below the lowermost plate or the bottom 71*c* of the housing 71, which additional conveyor means 86 is adapted for receiving the dried sawdust being deposited in the well means 80*d* and for feeding such sawdust back onto the feed conveyor means 70*a*. It is apparent that the feed conveyor means 70*a* will then again feed the sawdust thus received thereby into the successive buckets 74*c* on the upright conveyor means 74 for delivering the same into the upper end of the housing 71 for recycling the dried sawdust through the dryer 71.

The additional conveyor means 86 is shown in FIG. 4 in the form of a screw conveyor or auger 86*a* whose lower or rear portion is positioned beneath the rear lower portion of the transfer conveyor means 85 and within the second well means 80*d* of housing 81. The additional conveyor means 86 may be driven by any suitable means such as an electric motor 86*b*, and suitable switch means, not shown, may be provided for shutting off the electric motor 85*e* whenever the electric motor 86*b* is energized, and vice versa.

The screw conveyor 86*a* is supported in a tubular member 86*c* suitably supported by the housing 71 of the dryer 70 and having an outlet member 86*d* connected to the upper end thereof for directing the sawdust conveyed by the screw conveyor 86*a* onto the upper run of the endless feed conveyor 70*a* of the dryer 70.

From the foregoing description, it can be seen that the feed conveyor means 70*a* (FIGS. 3 and 4) and the upright bucket conveyor means 74 collectively constitute a first conveyor means for moving sawdust to be dried from a source to and into the top of the housing 71 of the dryer 70 and onto the uppermost dryer plate 72 therein, and the transfer conveyor means 85 serves as a second conveyor means for moving the sawdust, after drying thereof, from the lower end of the housing 71 of the dryer 70 to a first storage means embodied in the dried sawdust hopper 90 (FIGS. 1 and 2).

As preferred, the lower portion of the sawdust hopper 90 is tapered as shown in FIG. 2 so as to aid in directing the sawdust in the hopper 90 onto the upper run of a third conveyor means 95 for feeding the dried sawdust from the first storage means or hopper 90 to the grinding means or hammer mill 100. The hammer mill 100 may be of any desired type which will grind the dried sawdust into relatively small sawdust particles and fibers of the desired size not exceeding a predetermined maximum size, for obtaining an efficient highly combustible fuel. Accordingly, a detailed description and illustration of the hammer mill 100 and its associated conveyor means 95 is deemed unnecessary. If desired, the conveyor means 95 may be of the same type as that transfer conveyor means 85 heretofore described with respect to FIG. 4.

Conventionally, the hammer mill 100 has an exhaust fan means 101 operably associated therewith for discharging the ground, dried sawdust from the hammer mill 100 and pneumatically conveying the sawdust along a conveyor means or conduit 105 into the upper end of the storage bin 110 for the ground sawdust. Other than serving for the storing of relatively large quantities of the dried sawdust, the storage bin 110 has no particular purpose insofar as the processing of the sawdust into a dry, highly combustible wood fiber fuel is concerned. Accordingly, the lower portion of the storage bin 110 may include suitable conveyor means, not shown in FIG. 2, but which may be similar to that shown in the right-hand portion of FIG. 3, for selectively discharging sawdust from the lower portion of the storage bin 110 to the inlet or ingress lower end of an upwardly and forwardly inclined conveyor means 115. The conveyor means 115 is arranged for feeding sawdust from the storage bin 110 into the inlet, not shown, in the top of the kiln supply hopper 120. The conveyor means 115 may be in the form of a screw conveyor means or an endless belt conveyor means such as that indicated at 85 in FIG. 4. The conveyor means 115 may be operated at desired intervals for maintaining a supply of dried sawdust in the kiln supply hopper 120.

Figure 7:
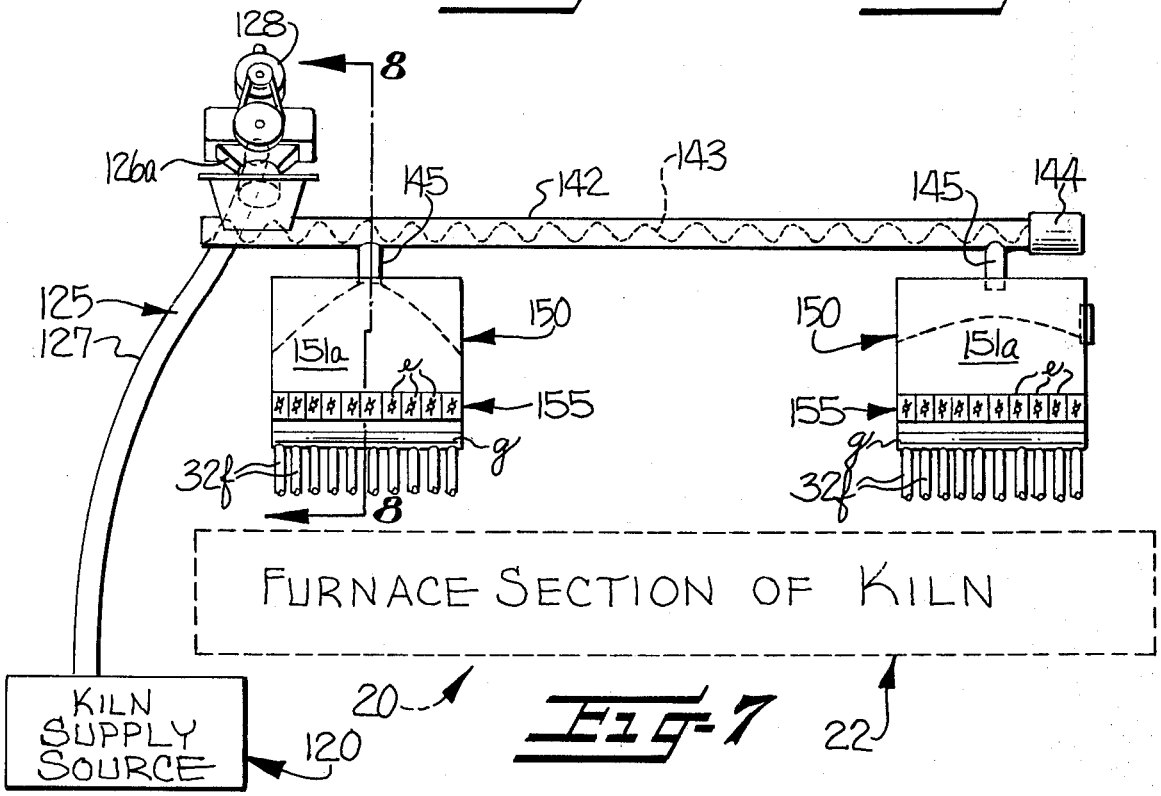
FIG. 7 is a schematic illustration of a pair of sawdust distributors positioned above the furnace section of the kiln, and showing how the sawdust may be conveyed from the kiln supply source or hopper to the sawdust distributors which control the flow of dried sawdust into the sawdust burners of the kiln.
Figures 8, 9:
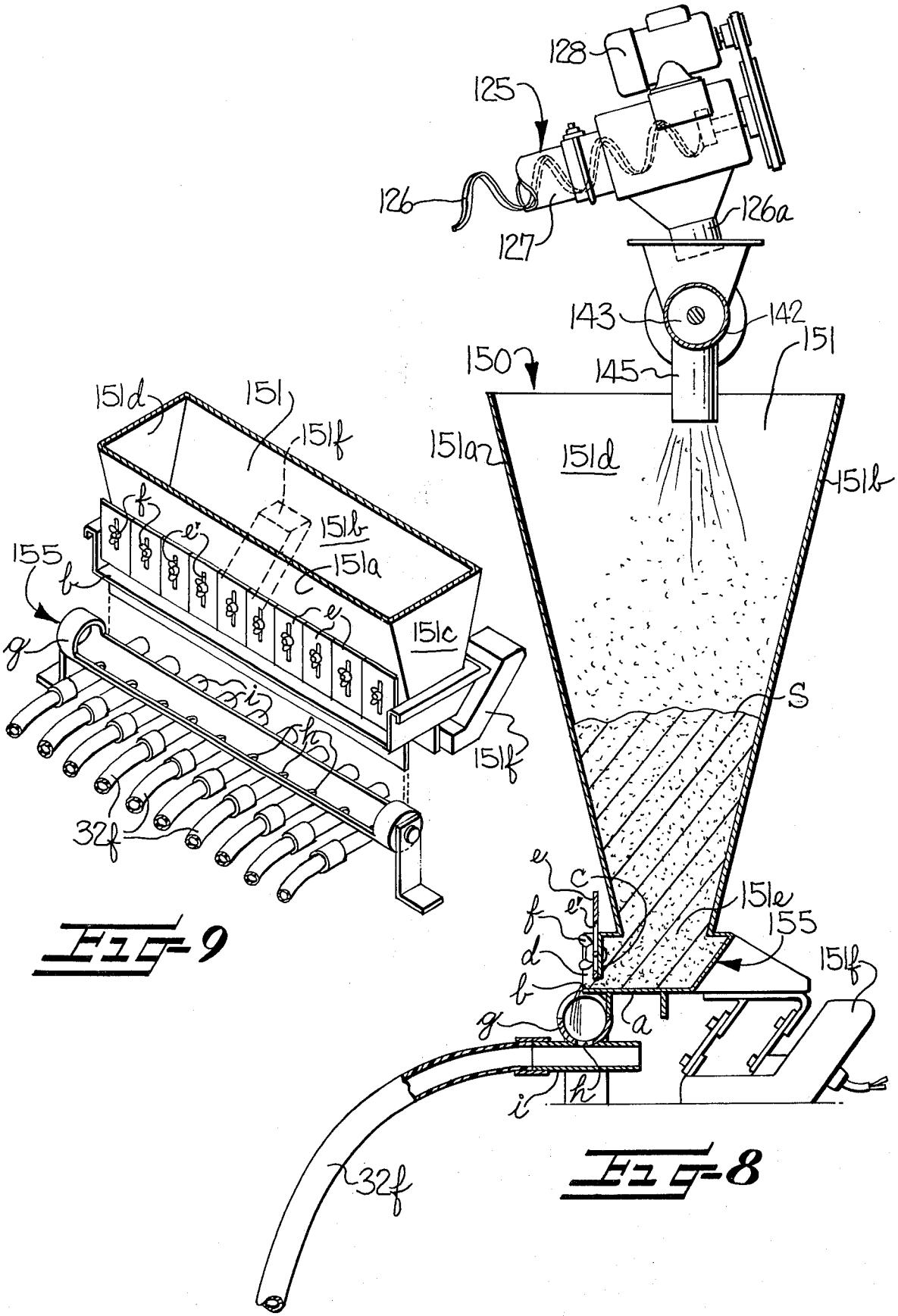
FIG. 8 is an enlarged fragmentary vertical sectional view, partially in elevation, taken substantially along line 8—8 in FIG. 7.
FIG. 9 is a partially exploded perspective view of the sawdust metering means associated with the lower portion of each sawdust distributor.
Figure 10:
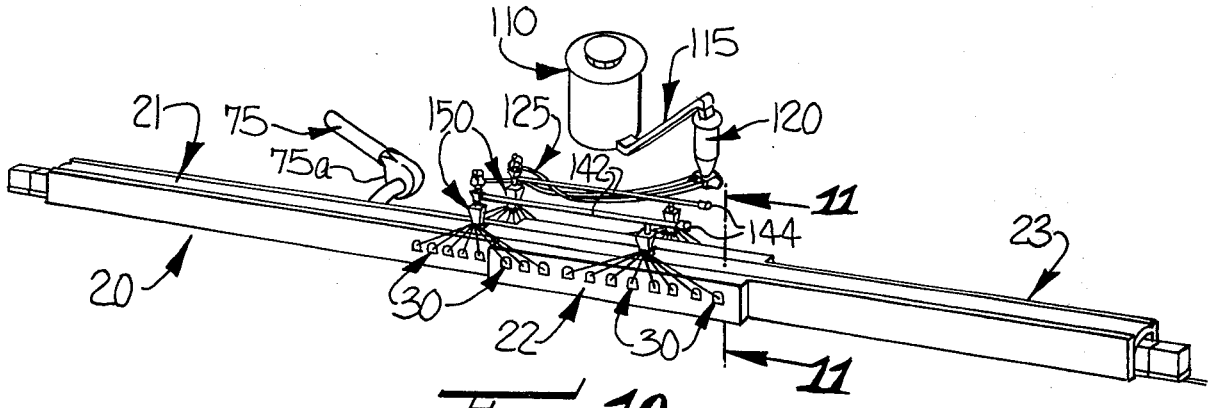
FIG. 10 is a schematic perspective view of the brick kiln shown in the lower portion of FIG. 1 and in the right-hand portion of FIG. 2, and illustrating how dried sawdust may be conveyed from the kiln supply hopper to a pair of the sawdust distributors positioned adjacent opposite sides of and above the brick kiln.

The kiln supply hopper 120 (FIG. 2) serves as a storage means or source of ground dried sawdust for the sawdust burners 32, 132 (FIGS. 11 and 12). Therefore, the kiln supply hopper 120 preferably has an inverted conical lower portion 130 (FIG. 2) for directing dried sawdust stored therein to suitable conveyor means, broadly designated at 125, for feeding the sawdust to the aforementioned sawdust distributors 150 (FIGS. 1, 2 and 7–11). The conveyor means 125 may take any suitable form and is shown in the form of a pair of flexible auger conveyors 126 in FIGS. 2, 7, 8, and 11. Each auger conveyor 126 is enclosed in a conveyor tube 127 and is driven by an electric motor 128 shown connected to the end of the respective auger conveyor 126 remote from the kiln supply hopper 120 (FIG. 2). As shown in FIGS. 7 and 8, each auger conveyor 126 is provided with an outlet portion 126*a* which deposits the sawdust in an elongate housing or tubular body 142 enclosing an auger conveyor 143, there being one of the auger conveyor housings 142 illustrated positioned adjacent each side of and above the brick kiln in FIG. 11.

Each of the auger conveyors 143 may be driven by an electric motor 144 (FIG. 7) mounted at one end of the respective tubular housing 142. As best shown in FIGS. 7, 8, and 11, the tube 142 of each auger conveyor 143 is provided with a pair of longitudinally spaced, downwardly extending outlets 145 each of which is adapted to discharge the sawdust from the corresponding auger conveyor 143 into the hopper 151 of a respective one of the sawdust distributors 150, there being four of the sawdust distributors 150 shown provided for accommodating the forty burner units 30 of the kiln of FIGS. 7, 10, and 11, in this instance. However, it is apparent that two of the sawdust distributors 150 have been omitted in FIG. 1, since FIG. 1 is a schematic illustration of the invention.

Since all of the four sawdust distributors 150 may be of substantially the same construction, only one of them will be described in detail, with particular reference to FIGS. 7, 8, and 9. As there shown, each hopper 151 may accommodate ten sawdust burners 32, 132 and includes opposing front and rear walls 151*a*, 151*b* and opposing side walls 151*c*, 151*d* whose lower portions define a throat 151*e* (FIG. 8) through which the dried sawdust gravitates into a sawdust metering chamber 152 (FIG. 8) of a metering means broadly designated at 155.

The metering chamber 152 is vibrated at a predetermined frequency during the operation of each respective sawdust distributor 150 by any suitable means such as an electric vibrator means generally designated at 151*f*, and which serves as a support for the corresponding hopper 151 and its metering means 155. The walls of the sawdust metering means 155 collectively define the metering chamber 152 somewhat in the form of an elongated channel or trough which is open at one side threof. Therefore, a bottom wall a of the chamber 152 has a front end portion terminating in a lip portion b cooperating with an elongate front wall c of the metering chamber 152 to define a sawdust discharge mouth, opening or slot d therebetween. The front wall c of the metering chamber 152 is provided with a plurality of vertically adjustable valve members or gates e (FIGS. 7, 8 and 9), each of which may be adjusted to vary the size of the corresponding portion of the throat d between the lower edge of the respective gate e and the upper surface of the lip portion b of the bottom wall a of the metering means 155.

In this instance, since each hopper 151 accommodates ten of the sawdust burners, ten of the gates e are provided on the corresponding metering means 155 in FIGS. 7 and 9. For permitting vertical adjustment of each gate e, each gate has a substantially vertical adjustment slot e′ therein penetrated by a bolt carried by the wall c and having a wing nut f thereon. Each wing nut thus serves as an embodiment of fastening means for releasably retaining each respective gate e in the desired adjusted position with respect to lip portion b.

Secured to the lower front portion of the bottom wall a of the metering means 155 is an elongate trough g which is thus vibrated with the latter bottom wall a by the vibrating means or vibrator 151*f*. The trough g extends longitudinally along and beneath the overlying lip b of the respective metering means 155, and each trough g has a row of holes or openings h therethrough corresponding to each respective gate e, and being substantially vertically aligned with the respective gates e and with the leading edge of the lip portion b of the metering means 155.

Welded or otherwise suitably secured to the bottom portion of the trough g and communicating with the respective openings h in the trough g are a plurality of substantially horizontally positioned tubular adapters or fittings i, to the forward ends of which the upper rear ends of the respective sawdust conveying conduits or pipes 32*f* are communicatively connected. It is thus seen that metered amounts of sawdust flow successively beneath the respective gates e (FIGS. 8 and 9), over the lip portion b, into the trough g, and through the holes h into the tubular adapters i. The ends of the tubular adapters i remote from the respective sawdust conveying conduits 32*f* are open to the atmosphere so that, when the respective valves 32*g* (FIG. 11) are open, an airstream is directed into and through the respective burner unit through the respective air pipe or conduit 32*e*, and the aspirating effect thus produced at the pipe fitting 32*d* of the respective sawdust burner 32 causes an airstream to flow into the respective adapter i (FIG. 8). In so doing, the airstream entering the adapter i flows along the respective sawdust conveying conduit 32*f* and thereby induces the flow of sawdust from the respective distributor 150 into the respective sawdust burner unit 32 and also serves to provide oxygen for combustion of the sawdust in the kiln.

It is believed that the operation of the apparatus and the method of the present invention are clearly set forth in the foregoing description and, accordingly, a further description thereof is deemed unnecessary.

In the drawings and specifications there has been set forth a preferred embodiment of the invention, and although specific terms are employed, they are used in a generic and descriptive sense only, and not for purposes of limitation, the scope of the invention being defined in the claims.

What is claimed is:

1. In a kiln having an elongate housing defining a tunnel for the passage therethrough of brick to be treated, the combination therewith of apparatus for utilizing dried sawdust for the fuel to heat the kiln to effect the desired treatment of the bricks, said apparatus comprising a plurality of elongate sawdust burner units positioned along the housing and extending into the tunnel, each of said burner units comprising a pipe having an inner end extending into the tunnel of the kiln and an outer end, aspirator means communicatively connected to the outer end of the pipe, said aspirator means having a pair of outer connections, means for directing an airstream from a source into and through each of the burner units and comprising a first conduit means connecting one of said pair of outer connections of said aspirator means to the source of the airstream, and means for directing dried sawdust from a source into the airstream in each of the burner units comprising a second conduit means connecting the other of said pair of outer connections of said aspirator means to the source of the sawdust so that the airstream induces the flow of sawdust from the source of sawdust into each of the burner units and also serves to provide oxygen for combustion of the sawdust.

2. A kiln according to claim 1 wherein said burner units are arranged in spaced relation along the housing of the kiln with at least some of the burner units extending into the tunnel from along the top of the housing.

3. A kiln according to claim 1 wherein the housing of the kiln includes opposing side walls and a top wall and wherein said burner units are arranged in spaced relation along both side walls and the top wall of the kiln.

4. In a kiln having an elongate housing defining a tunnel for the passage therethrough of brick to be treated, the combination therewith of apparatus for utilizing dried sawdust for the fuel to heat the kiln to effect the desired treatment of the bricks, said apparatus comprising a plurality of elongate sawdust burner units positioned along the housing and extending into the tunnel, each of said burner units comprising a pipe having an inner end extending into the tunnel of the kiln and an outer end, aspirator means communicatively connected to the outer end of the pipe, said aspirator means having a pair of outer connections, means for directing an airstream from a source into and through each of the burner units and comprising a first conduit means connecting one of said pair of outer connections of said aspirator means to the source of the airstream, and means for directing dried sawdust from a source into the airstream in each of the burner units comprising a second conduit means connecting the other of said pair of outer connections of said aspirator means to the source of the sawdust so that the airstream induces the flow of sawdust from the source of sawdust into each of the burner units and also serves to provide oxygen for combustion of the sawdust, and a plurality of gas burner units also positioned along the housing and communicating with the tunnel for directing gaseous fuel into, and causing the same to burn in, the tunnel.

5. A kiln according to claim 4 wherein the housing of the kiln includes opposing side walls and a top wall and wherein said sawdust burner units and said gas burner units are arranged in spaced relation along both side walls of the kiln.

6. A kiln according to claim 4 wherein at least some of said sawdust burner units are arranged to extend into the kiln from along the top wall of the kiln.

7. A kiln according to claim 4 wherein each of said gas burner units includes a tubular ceramic member through which the gaseous fuel flows into the kiln, and wherein each of said sawdust burner units includes a tubular body through which the sawdust flows into the kiln, and wherein the tubular bodies of at least some of said sawdust burner units extend axially through and in spaced relation to certain ones of said tubular ceramic members of said gas burner units for aiding in preventing overheating of the tubular bodies of said sawdust burner units during operation of the kiln.

* * * * *